US005242169A

United States Patent [19]

Laabs

[11] Patent Number: 5,242,169

[45] Date of Patent: Sep. 7, 1993

[54] GOLF PUTTING PRACTICE DEVICE

[75] Inventor: James V. Laabs; Roxanne C. Douglas, both of Madison; Ronald G. Hellenbrand, Middleton, all of Wis.

[73] Assignee: Douglas & Laabs, Inc., Madison, Wis.

[21] Appl. No.: 900,934

[22] Filed: Jun. 17, 1992

[51] Int. Cl.[5] ..... A63B 69/36

[52] U.S. Cl. ..... 273/179 C; 273/184 A

[58] Field of Search ..... 273/179 R, 179 C, 179 A, 273/179 B, 179 D, 179 E, 184 A, 185 R, 176 FA

[56] References Cited

U.S. PATENT DOCUMENTS

| | | | |
|---|---|---|---|
| D. 316,120 | 4/1991 | Morris et al. | D21/8 |
| 3,351,345 | 11/1967 | Robinette | 273/179 R X |
| 3,511,506 | 5/1970 | Schollick | 273/179 R |
| 3,645,536 | 2/1972 | Tierney | 273/176 FA X |
| 4,270,751 | 6/1981 | Lowy | 273/184 A X |
| 4,634,130 | 1/1987 | Simjian | 273/176 FA |
| 4,872,687 | 10/1989 | Dooley | 273/185 R |
| 4,966,370 | 10/1990 | Morris | 273/176 F |
| 5,067,718 | 11/1991 | Knox et al. | 273/185 R |
| 5,082,280 | 1/1992 | Wang | 273/179 C |
| 5,129,653 | 7/1992 | Morris et al. | 273/179 C |

*Primary Examiner*—George J. Marlo
*Attorney, Agent, or Firm*—Lathrop & Clark

[57] ABSTRACT

A thermoformed thermoplastic housing has a putting deck having an inclined ramp leading to a platform with a rear and a side ball gutter return. A cup extends beneath the deck and has a ball return outlet. The cup has a false bottom portion hingedly attached to a cup sidewall. In the cup bottom is a switch having a contact and a lever which extends into the cup beneath the false bottom. A miniature phonograph is activated by the switch when a putted ball engages the false bottom and plays a prerecorded message. A thermoformed thermoplastic support member extends beneath the cup and supports the phonograph and switch and stabilizes the deck. To insure adequate dwell time of the ball on the false bottom, the false bottom pivots about a hinge axis which is perpendicular to the pivot axis of the switch lever.

7 Claims, 3 Drawing Sheets

GOLF PUTTING PRACTICE DEVICE

FIELD OF THE INVENTION

This invention relates to golf putting devices and more specifically relates to an apparatus for putting practice and amusement.

BACKGROUND OF THE INVENTION

Golf is a popular game, widely enjoyed throughout the world. While the basics of golf are easy to learn, the subtle skills of driving and putting may take years to develop. Although public and private golf courses are available in most cities, availability of an outdoor course will be dependent on weather conditions and the season. Furthermore, it is often impractical for a player to journey to a distant golf course for only a short practice round. To provide practice time off the course, a number of putting practice devices have been marketed.

Commercially available golf putting practice devices are known in the art, including those that simulate a golf putting green by using a closely cropped simulated grass indoor/outdoor carpeting material. These devices frequently have a ramped surface which leads up to a flat putting platform containing a golf putting cup. In some devices ramped returns bring the ball from the cup back to the initial putting surface.

In addition, there are devices for the serious golf student which sense golf ball speed and timing and which emit audible messages or visual messages to instruct the golfer in game improvement. Such sophisticated devices are expensive, due to their use of complicated photoelectric beam sensing devices, microprocessors and voice synthesizers, or light emitting diodes (LED). These devices may be programmed to deliver an oral message or compute measurements and relay the results visually or aurally.

Putting practice devices which provide detailed putt information may be intimidating to the casual player, and, due to the precision sensors and computers required, are costly to produce.

What is need is a play apparatus which permits golf practice and which interacts with the player yet which may be manufactured at a low cost.

SUMMARY OF THE INVENTION

The present invention provides a golf practice device which may be produced at low cost to serve as both a practice aid and a golf-related game or novelty. The game apparatus has a thermoformed thermoplastic housing with a deck having a putting ramp and platform covered with a simulated putting-green carpet. A putting cup extends beneath the platform. A recording playback unit comprised of a combined speaker and miniature record player is mounted beneath the cup by a thermoformed thermoplastic support member. The support member affixes the electronic components of the apparatus and extends beneath the deck to engage the apparatus support surface to stabilize the housing deck and ensure a stiff play surface. A false bottom plate is hinged to the sidewall of the putting cup. The false bottom overlies a lever and contact button of a switch. A made putt directs a ball into the cup and onto the false bottom. The weight of the ball on the false bottom plate depresses the false bottom to close the lever on the contact button. The closed switch activates the miniature record player. The record player plays several messages in a random sequence which are broadcast through the speaker.

It is an object of the present invention to provide a putting practice game apparatus which is inexpensive to manufacture, quick to assemble and which can be sold as a novelty item.

Another object of the present invention is to provide a game apparatus which is intended for amusement of the user as well as for golf putting practice.

Yet another object of the present invention is to provide a game apparatus with a mechanism which enables a putted ball to cause a switch to remain closed for sufficient duration to activate a recording.

An additional object of the present invention is to provide a golf practice game apparatus which plays random messages in response to made putts.

A further object of the present invention is to provide a low-cost contact mechanism such that a putted ball will leave the hole and be returned to the player.

A still further object of the present invention is to provide a putting practice game apparatus with a high degree of reliability such that when the ball enters the hole, a message is triggered substantially all of the time.

Further objects, features and advantages of the invention will be apparent from the following detailed description when taken in conjunction with the accompanying drawings.

DESCRIPTION OF THE PREFERRED EMBODIMENT

Figure 1:
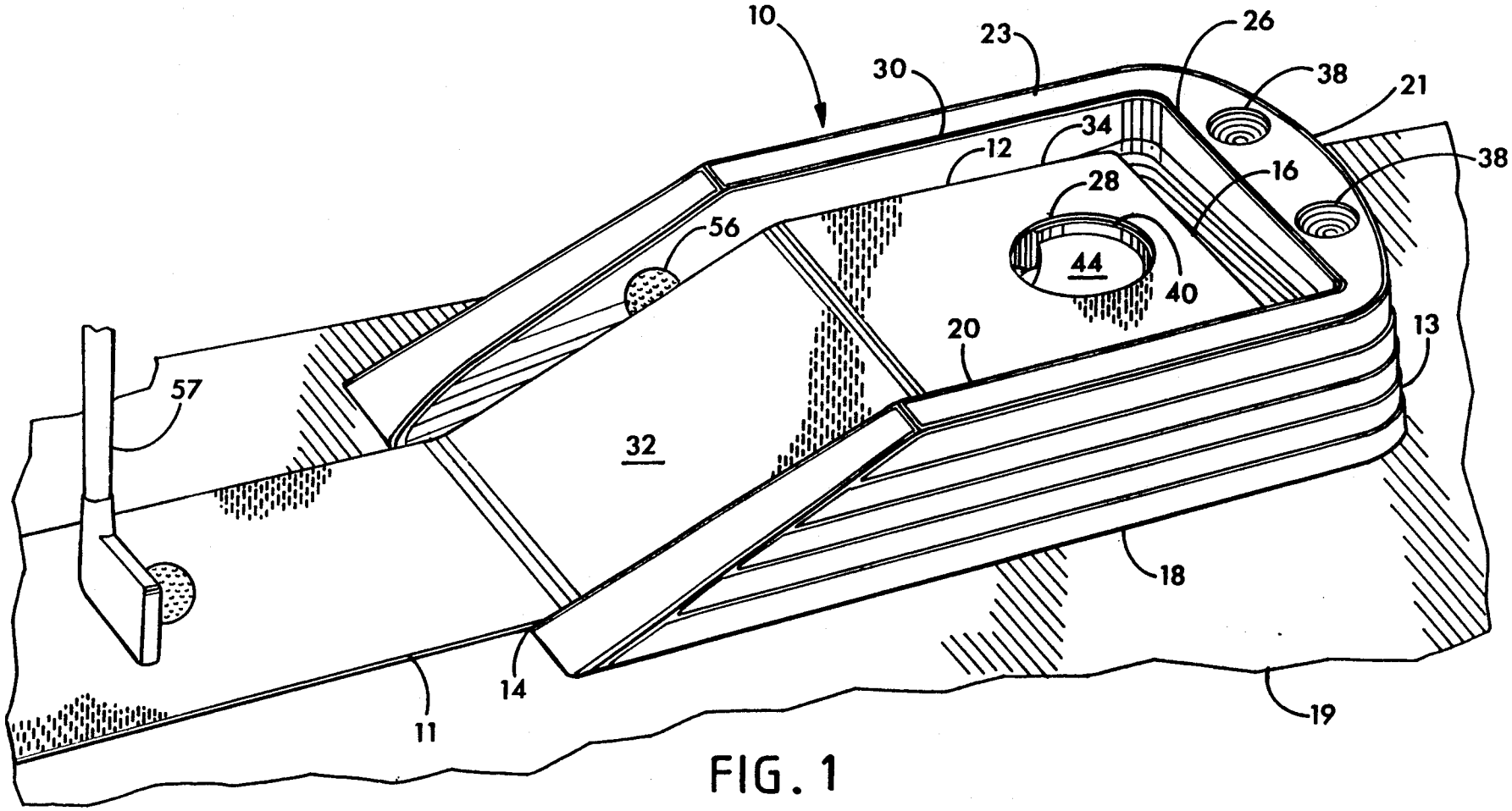
FIG. 1 is a perspective view of the golf practice game apparatus of the present invention.
Figure 2:
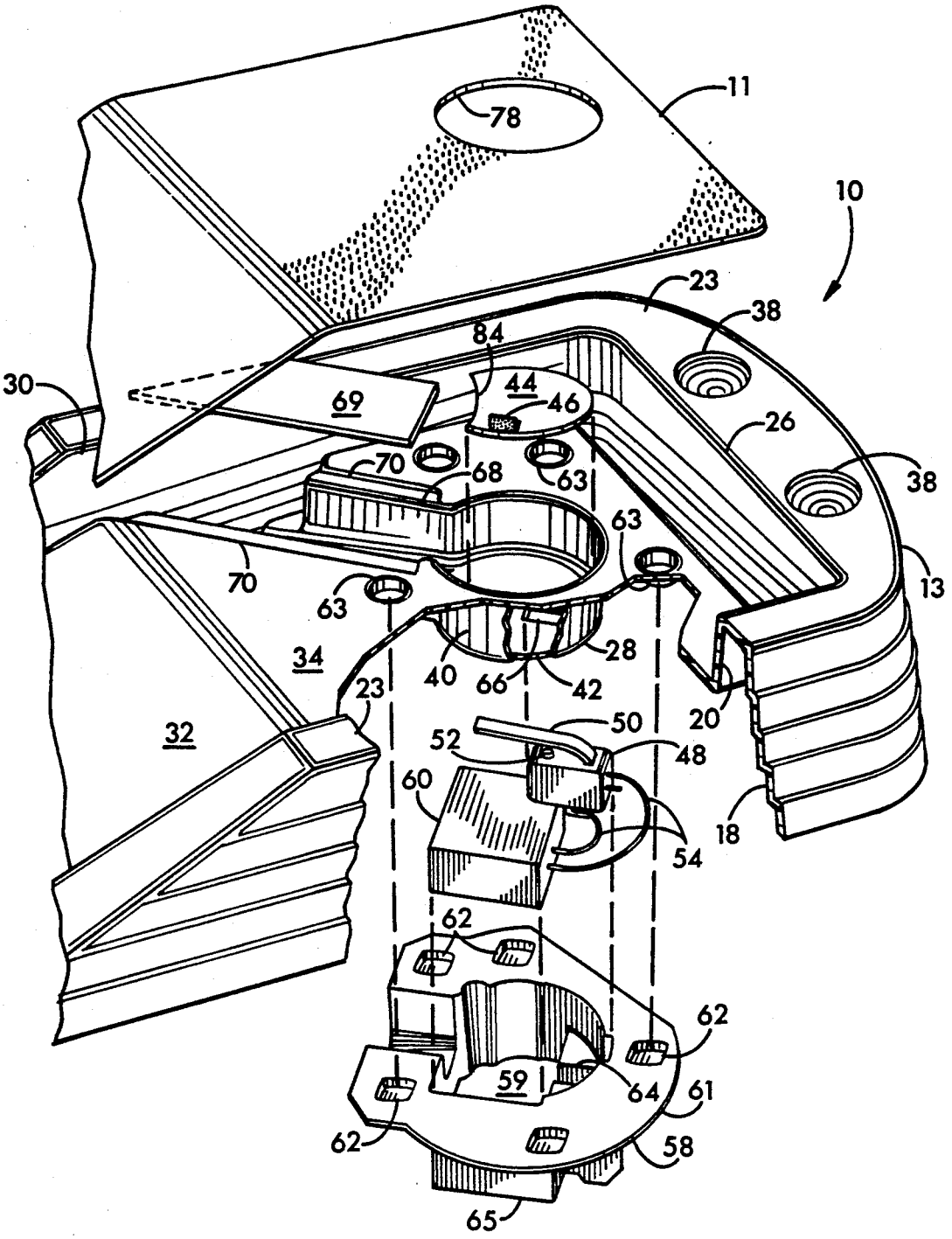
FIG. 2 is an exploded isometric view of the apparatus of FIG. 1.

Referring more particularly to FIGS. 1–4, wherein like numbers refer to similar parts, a golf practice game apparatus 10 is shown in FIG. 1. The game apparatus 10 has a grass-simulative carpet 11 which is connected to a stiff thermoformed thermoplastic housing 13. The housing has a deck 12 to which the carpet 11 is affixed. The deck 12 provides a rigid putting surface for a ball in play. The housing 13 is generally wedge-shaped with the deck front 14 at zero elevation adjacent the floor or other support surface 19 on which the housing rests. The housing has two side walls 18 and a rear wall 21, which extends into contact with the support surface 19, as shown in FIG. 1. At the rear 16 of the deck 12 there is an inclined rear ball gutter 26 which forms a U-shaped channel which acts as a return for balls which have not successfully been putted into a cup 28. The rear ball return gutter 26 adjoins and directs balls into the inclined side gutter return 30 which is also a U-shaped channel which returns the balls to the player. A horizontal lip 23 extends horizontally inwardly from the side and rear walls 20, 21. The lip 23 is above the level of the deck 12. The horizontal lip 23 has a depending inner sidewall 20 which extends downwardly to join the deck 12. The inner sidewall serves to deflect balls into the ball return gutters 26, 30. The curvature of the U-shaped channel of the ball return gutters 26, 30 is such that it conforms to the curvature of a golf ball 56. The standard golf ball diameter is approximately $1\frac{3}{4}''$.

The deck 12 of the game apparatus 10 has ramp 32 extending upwardly from the deck front edge 14 which inclines rearwardly to join a level platform 34. The lip 23 of the housing rearward of the rear ball return gutter 26 has portions defining semispherical depressions 38 of a size sufficient to accommodate golf balls. The depressions serve as golf ball storage pockets for balls not in play.

The cup 28 is generally cylindrical and depends downwardly from the deck platform 34 and is integral with it. The cup has downwardly depending sidewalls 40 which adjoin a cup bottom 42. The cup bottom 42 may be provided with two downwardly extending ridges 80, 82 formed therein. However, inn a preferred embodiment, the ridges will be omitted and a switch 48 position by accurate part dimensioning. The ridge 80 further restricts undesired forward motion of the switch 48. A generally circular thin plastic plate false bottom 44 is pivotally attached to the cup sidewall 40 by an adhesive flexible tape hinge 46, shown in FIGS. 2 and 3.

A ball return outlet 68 is formed in the housing 13 and extends beneath the level of the deck 12. The outlet 68 has a ramp 72 which is inclined downwardly and frontwardly from the cup bottom 42. The ramp 72 has a U-shaped profile similar to that of the ball return gutters 26, 30.

Two depressions 70 are formed in the deck 12 on either side of the ball outlet 68. A flat plate bridge member 69 is glued to the deck along the depressions 70. The bridge member spans the ball outlet 68 depression and is covered by the artificial turf carpet 11, such that a ball may only enter the ball outlet 68 through the cup 28.

In order to allow for gravity discharge of the golf ball 56 from the cup 28, the bottom 42 of the cup must be above the level of the side gutter return 30 and consequently spaced from the support surface 19 on which the housing rests. A thermoformed thermoplastic thin sheet support member 58 is molded in a shape which generally conforms to the sidewalls 40 of the cup 28, and which extends beneath the cup bottom 42. The support member 58 is itself a generally cup-shaped shell having a base 59 which engages against the support surface 19. The support member 58 has an upper flange 61 which engages beneath the level platform 34 of the deck 12. The flange 61 of the support member 58 has five downwardly extending depressions 62 which engage with five locating buttons or depressions 63 which extend downwardly from the deck 12. The interengaging depressions 62, 63 serve to accurately register the position of the support member 58 with respect to the housing 13 to insure proper alignment of the parts.

The support member contains in a compact package the switch 48 and the record player 60. To properly position the switch 48 with respect to the cup bottom 42, a molded switch cavity 64 is formed in the support member 58. A record player cavity 65 is formed in the support member 58 adjacent to the switch cavity.

The support member 58 desirably contributes to the rigidness and stability of the game apparatus 10. First, by extending into contact with the support surface 19, the support member 58 provides a central foot or pillar for the deck 12. Secondly, by retaining the dense record player and switch at a position within the apparatus very close to the support surface 19, the entire apparatus is given a very low center of gravity which makes the game apparatus resistant to undesired tipping.

Figure 3:
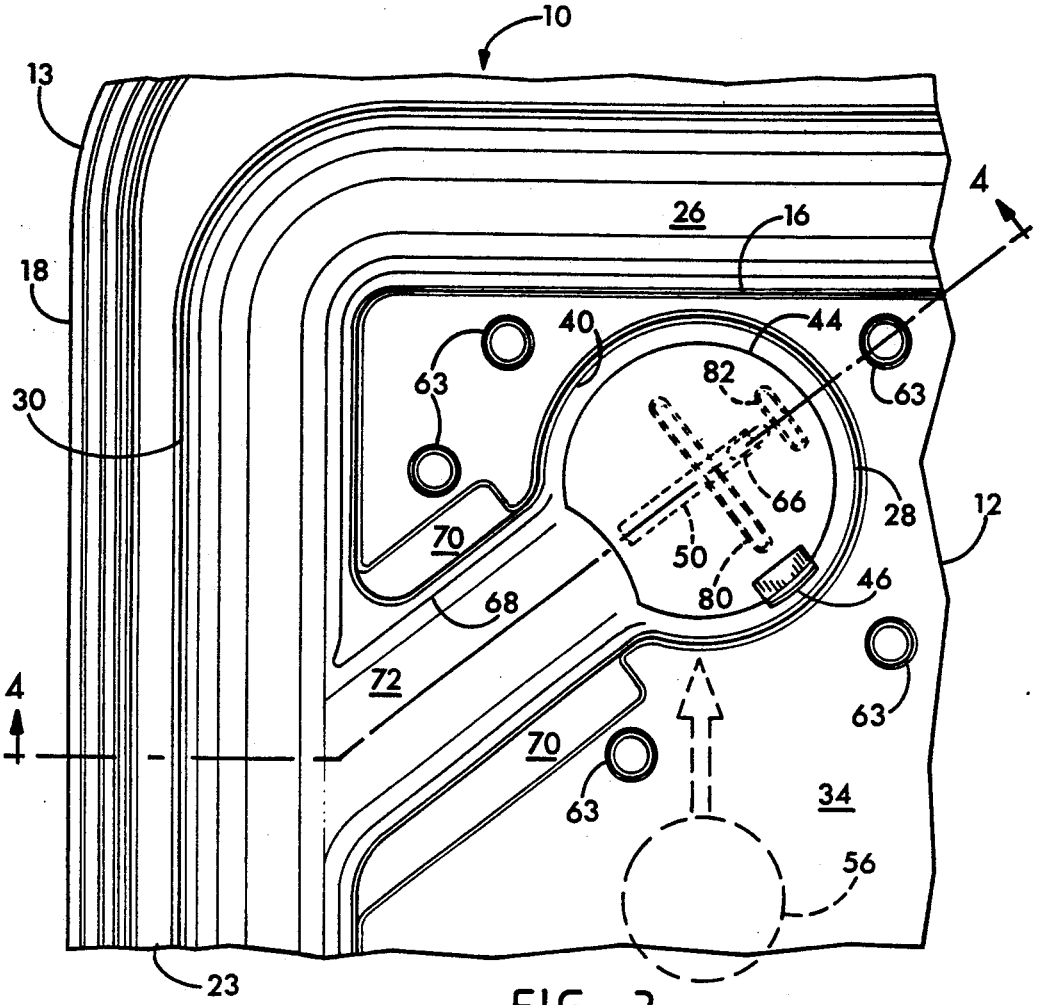
FIG. 3 is a fragmentary top plan view of the apparatus of FIG. 1.
Figure 4:
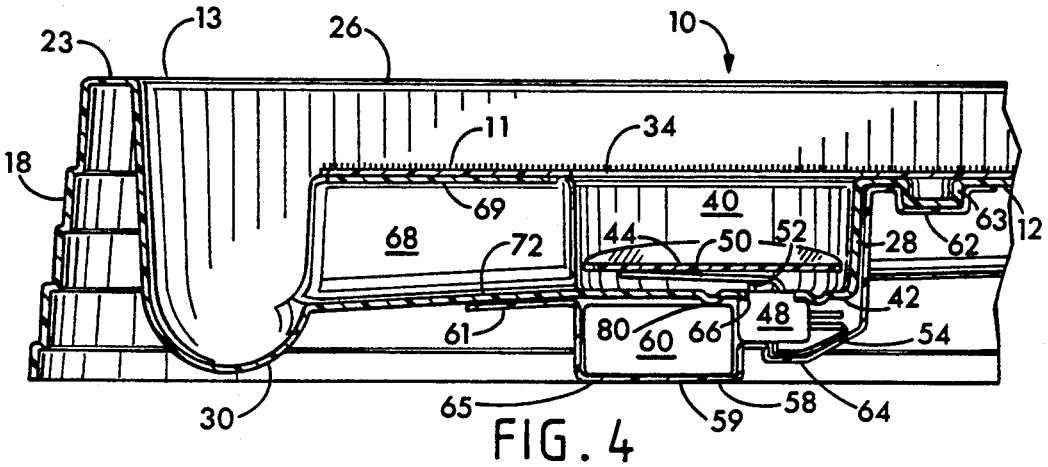
FIG. 4 is a cross-sectional view of the apparatus of FIG. 2, taken along section line 4—4.

As shown in FIGS. 3 and 4, the switch 48 is mounted within the switch cavity 64 such that the switch lever 50 and button contact 52 extend through a slot 66 in the cup bottom into the cup 28. The lever 50 extends above the cup bottom 42 parallel to the hinge 46 and at an angle of approximately 45 degrees to an axis extending from the front 14 to the rear 16 of the deck 12. The false bottom 44 is supported in a position slightly elevated above the cup bottom 42 by the lever 50. The switch 48 is connected by wires 54 to the record player 60.

As best shown in FIG. 1, the game apparatus 10 is used in conjunction with conventional golf balls 56 and a golf club 57. The artificial turf carpet 11, which is glued to the deck 12 of the housing 13, extends frontwardly from the housing by several feet. The player positions the ball on the carpet 11 and strikes the ball with the club 57, directing the ball up the inclined portion 32 of the deck and towards the cup 28. If not accurately struck by the club, the ball 56 will miss the cup 28 and will enter the rear or side gutter 26, 30 and be returned to the player. If the player's stroke is successful, the ball will enter the cup 28.

The game apparatus 10 interacts with the player by emitting an audible response to a made putt. This response will generally be in the form of verbal comments, recorded on a miniature record and played in random order by a conventional miniature record player 60.

The audible response is initiated by the weight of the ball within the cup depressing the false bottom 44 to pivot the lever 50 of the switch 48 downwardly to depress the contact button 52 and close the switch, sending a signal to the record player 60 to initiate a play sequence.

When a putt is made, the ball must be disposed of from the cup 28 through the outlet 68. If the ball were allowed to rest on the switch and remain there it would cause the record player to play continuously.

Although sensors are known which can detect a nearly instantaneous switch closure, such devices are relatively costly. Furthermore, the tiny signal from a very short switch closure would need to be amplified to activate a device such as the record player 60.

The game apparatus 10 utilizes a low-cost switch in conjunction with a mechanically produced ball dwell time to achieve a switch closure of sufficient duration to consistently actuate the record player 60. An exemplary switch of the type utilized in the game apparatus 10 is the V3L-2106-D8 basic miniature switch manufactured by Microswitch of Freeport, Illinois.

Optimal ball dwell within the cup 28 is accomplished by the false bottom 44, the lever 50, and by the positioning of the hinge 46. In the preferred embodiment the thickness of the false bottom 44 is approximately 3/32". The false bottom is thus lightweight yet sufficiently stiff that the weight of a ball on the false bottom causes it to pivot about the hinge 46 as a planar member without significant bending of the false bottom 44 itself.

The switch lever 50 is selected according to the amount of force needed to depress it. For repeatable operation with a standard weight golf ball, a switch 48 requiring an operating force of 0.55 to 0.75 ounces at the end of the lever 50 is employed. It has been observed that optimal dwell time with consistent discharge of the ball 56 is achieved by orienting the pivot axis of the false bottom 44 (defined by the hinge 46) substantially perpendicular to the pivot axis of the lever 50 of the switch 48. As best shown in FIG. 3, in which the carpet 11 has been omitted for clarity, the lever 50 is mounted at approximately 45 degrees to a line extending from the front to the rear of the deck, and the hinge is mounted to the cup sidewall 40 parallel to the lever 50.

This hinging arrangement results in an approximately 15 degree angle of the false bottom 44 with respect to the bottom 42 of the cup 28 when no ball is in the cup. The weight of the false bottom thus does not close the switch, as the false bottom must be depressed 15 degrees to close the switch. Once a ball enters the cup 28 and contacts the false bottom 44, the lever 50 is depressed to close the switch 48. As the ball rolls off the false bottom, the switch remains closed the entire time, that the ball engages the false bottom, bringing about successful activation of the record player 60.

The carpet has an opening 78 in registry with the circular opening of the ball retaining cup 28. The carpeting is of the conventional simulated grass indoor-/outdoor type. The phonograph 60 operates on a small (AA) battery (not shown) for ease of use. The miniature phonograph 60 is available at a reasonable cost and plays a record with different messages in a random sequence. The random sequence is important because it provides an element of suspense or surprise each time a put is made. The record player 60 has an integral speaker which projects sound upwardly through the bottom 42 of the cup 28. The record player provides typically five short pre-recorded messages such as "Hey, I betcha ya can't do that again," or "Nice putt," with an applause sound, or similar comments. The phonograph is preferably of the type manufactured by Ozen Sound Devices of New York, New York.

In order to produce a putting surface which accurately simulates an actual putting green, it is desireable to minimize the incline of the ramp 32 and hence the overall elevation of the housing 13. However, the ball return gutters 26, 30 and the return outlet 68 are preferably inclined as steeply as possible to ensure a positive ball velocity sufficient to overcome any frictional resistance.

The need to preserve elevation of the cup bottom above the level of the side gutter, while at the same time keeping the deck platform 34 as low as possible, dictates that a close clearance will be present between the ramp and the bridge member 69 where the cup 28 discharges to the ball outlet 68. Although not essential, an additional clearance distance may be provided at this critical region by providing the false bottom, which has a generally circular perimeter, with a cut-away segment 84 recessed from the circular perimeter. This arcuate cut-away portion increases the clearance at the entrance to the outlet 68 by removing the thickness of the false bottom at just that location.

It is understood that the present invention is not confined to the particular construction and arrangement of parts herein illustrated and described, but embraces such modified forms thereof as come within the scope of the following claims.

We claim:

1. A golf putting practice game apparatus comprising:

a) a thermoformed thermoplastic housing having a planar deck which defines a putting surface wherein the housing has housing sidewalls which extend beneath the deck and are adapted to engage against a planar support surface, and wherein portions of the housing define a generally cylindrical putting cup depressed beneath and depending from the deck, the deck putting cup having walls which depend from the deck and a base extending below the walls, and having portions defining a slot opening upwardly into the cup;

b) a switch mounted beneath the cup, the switch having a lever pivotable about a first axis, wherein the lever extends into the cup through the cup slot;

c) a recording playback unit electrically connected to the switch such that depression of the switch lever actuates the playback unit;

d) a planar which fits within the cup to overlie the pivotable lever;

e) an adhesive flexible hinge fastened to the false bottom which pivotably connects the false bottom to a cup wall, wherein the hinge is located approximately parallel to the lever such that the false bottom pivots about an axis approximately perpendicular to the switch lever first axis; and f) portions of the housing defining a ball return ramp which extends from the cup, such that a ball received within the cup will depress the false bottom and the adjacent switch lever portion to close the switch and activate the recording playback unit to emit an audible message, and the ball will travel over the false bottom to be directed by the return ramp away from the cup.

2. The apparatus of Claim 1 further comprising a thermoformed thermoplastic support member fastened to the housing deck and having sidewalls which extend beneath the deck and outside the cup side walls, wherein the support member has a base with portions defining a switch-receiving depression therein and wherein the switch is mounted in the switch-receiving depression such that the switch lever extends through the cup slot, and wherein the support member base is adapted to engage against the planar support surface to stabilize and support the deck.

3. The apparatus of Claim 1 wherein the false bottom has a generally circular perimeter, such that the perimeter is closely spaced from the cup walls, and wherein portions of the false bottom define an arcuate cut-away segment recessed from the circular perimeter.

4. The apparatus of Claim 1 wherein the false bottom is hinged to the sidewall adjacent the cup base, such that the false bottom is disposed at an angle of approximately 15 degrees with respect to the cup base when the switch is unactivated.

5. A golf putting practice game apparatus comprising:

a) a thermoformed thermoplastic housing having an elevated deck which defines a planar putting surface, wherein the housing has sidewalls which extend beneath the level of the deck and are adapted to engage against a planar support surface;

b) portions of the housing which define a cup which depends from the deck;

c) a thermoformed thermoplastic support member connected to the deck to surround the cup, the support member having downwardly extending sidewalls and a base which is adapted to engage against the support surface to support and stabilize the elevated deck;

d) a planar false bottom pivotally mounted within the cup;

e) a switch mounted within the support member to extend into the cup and engage against the false bottom, such that when the false bottom is pivoted downwardly by the weight of a ball received within the cup, the switch is activated;

f) a recording playback device electrically connected to the switch such that activation of the switch causes an audible message to be delivered by the unit; and g) portions of the housing defining an inclined ramp leading away from the cup, to outlet such that a ball received within the cup will be d from the housing through the outlet.

6. The apparatus of Claim 5 further comprising:

a) portions of the housing defining depressions formed in the housing which extend beneath the deck; and b) portions of the support member which define a flange extending outwardly from the support member sidewalls, and portions of the flange define depressions which correspond to the deck depressions, wherein the flange depressions engage with the deck depressions to accurately position the support member with respect to the deck.

7. The apparatus of Claim 5 further comprising:

a) portions of the support member which define a cavity which surrounds and supports the switch; and b) portions of the support member which define a cavity beneath the switch cavity which supports the recording playback unit.

* * * * *

UNITED STATES PATENT AND TRADEMARK OFFICE

CERTIFICATE OF CORRECTION

PATENT NO. : 5,242,169

DATED : September 7, 1993

INVENTOR(S) : Laabs, et al.

It is certified that error appears in the above-indentified patent and that said Letters Patent is hereby corrected as shown below:

In column 3, line 14 of the issued patent, delete "inn a preferred embodiment" and substitute --in a preferred embodiment-- therefor.

In column 6, line 9 of the issued patent, delete "a planar which fits within the cup" and substitute --a planar false bottom which fits within the cup-- therefor.

In column 7, line 4 of the issued patent, delete "away from the cup, to outlet such" and substitute --away from the cup to an outlet, such-- therefor.

In column 7, line 5 of the issued patent, delete "will be d from the" and substitute --will be discharged from the-- therefor.

Signed and Sealed this

Third Day of September, 1996

*Attest:*

Bruce Lehman

BRUCE LEHMAN

*Attesting Officer*

*Commissioner of Patents and Trademarks*